United States Patent [19]

Grass

[11] 4,335,805

[45] Jun. 22, 1982

[54] LIFT DEVICE

[76] Inventor: Gerd Grass, Talstrasse 16, 4930 Detmold 19, Fed. Rep. of Germany

[21] Appl. No.: 137,065

[22] Filed: Apr. 3, 1980

[30] Foreign Application Priority Data

Apr. 9, 1979 [DE] Fed. Rep. of Germany ..... 2914350
Nov. 20, 1979 [DE] Fed. Rep. of Germany ..... 2946780

[51] Int. Cl.[3] ..... B66B 9/06

[52] U.S. Cl. ..... 187/12; 74/424.8 R; 187/25

[58] Field of Search ..... 187/12, 14, 25, 10, 187/24; 74/424.8 R

[56] References Cited

U.S. PATENT DOCUMENTS 1,473,813 11/1923 Crispen ..... 187/12
1,838,204 12/1931 Wood ..... 187/12
2,270,735 1/1942 Kundsen ..... 74/424.8
2,824,623 2/1958 Nord et al. ..... 187/12
2,950,948 8/1960 Hardigan et al. ..... 187/12
4,174,023 11/1979 Dooley ..... 187/12

*Primary Examiner*—Robert J. Spar
*Assistant Examiner*—Kenneth Noland
*Attorney, Agent, or Firm*—Jones, Tullar & Cooper

[57] ABSTRACT

A lift device comprising a driving device, a displaceable load-receiving device in the form of a platform or seat driven by the driving device, guide device for guiding the load-receiving device up or down a flight of steps, the load-receiving device being journalled for displacement and a drive spindle for effecting the displacement, the drive spindle being provided on the load-receiving device so as to be displaceable therewith, support rails secured alongside the flight of steps for guiding the spindle, the spindle having a thread and the support rails including a guide device having a thread co-operating with the spindle thread, the co-operation of the threads determining the path of travel of the load-receiving device.

9 Claims, 9 Drawing Figures

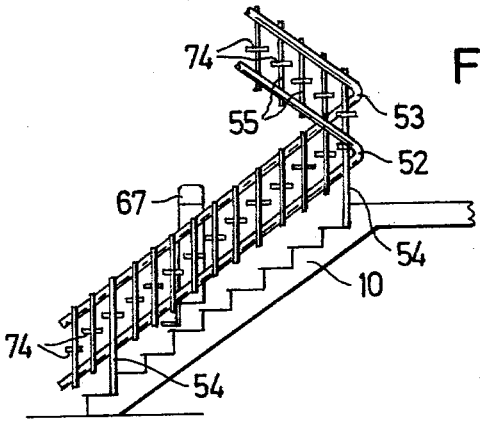
Fig. 6
Fig.9
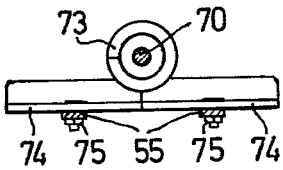
Fig.7
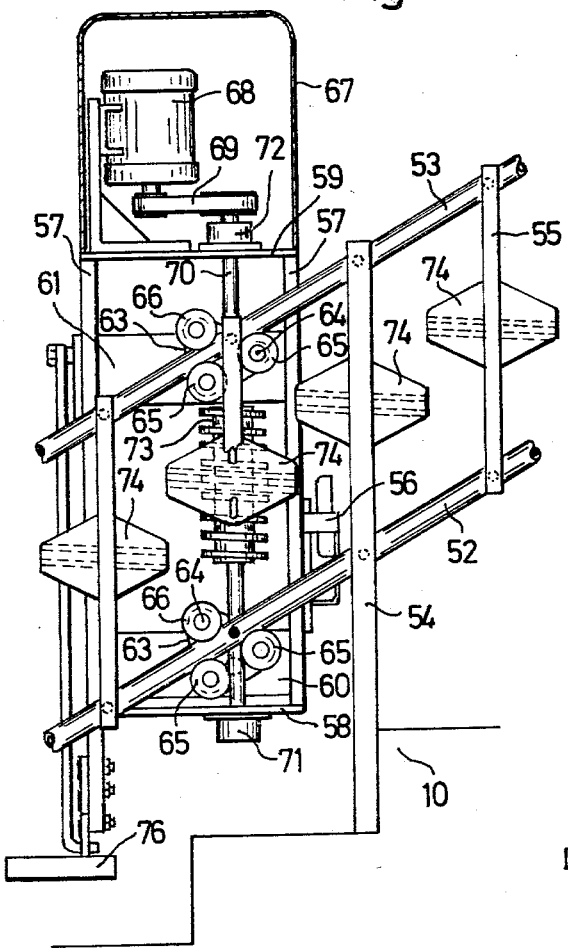
Fig.8
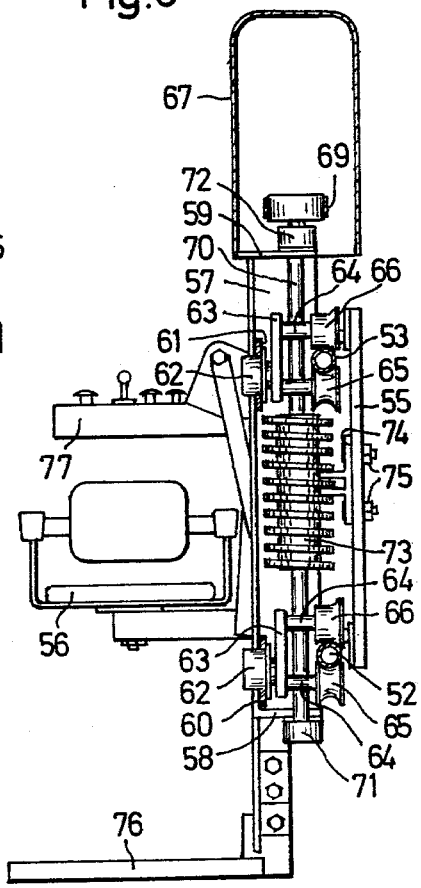

LIFT DEVICE

BACKGROUND OF THE INVENTION

1. Field of the Invention

The present invention relates to a lift device of the type which comprises a driven load-receiving member in the form of a platform or seat which is guided along a flight of steps. Such hoist or lift devices are used, for example, as emergency lifts and can be fitted onto existing staircases.

2. Description of the Prior Art

U.S. Pat. No. 2,270,735 discloses a lift in which a platform acting as a load-receiving member is displaceably mounted by means of a lifting spindle extending at a fixed angle with respect to the gradient of the steps.

Using such a driving spindle the load-receiving device can be moved only in straight lines and not around curves. Such a construction also fails to comply with certain safety regulations.

The present invention seeks to provide a lifting device of relatively simple construction which fulfils the safety regulations, gives maximum room for the load-receiving device and can pass around corners but which does not reduce the free width of the flight of steps.

SUMMARY OF THE INVENTION

In accordance with the present invention there is provided a lift device comprising drive means, a displaceable load-receiving device in the form of a platform or seat driven by said drive means, guide means for guiding said load-receiving device up or down a flight of steps, said load-receiving device being journalled for displacement and a drive spindle for effecting said displacement, said drive spindle being provided on said load-receiving device so as to be displaceable therewith, support rails secured alongside said flight of steps for guiding said spindle, said spindle having a thread and said support rails including a guide device having a thread co-operating with said spindle thread, said co-operation of said threads determining the path of travel of said load-receiving device.

In a preferred embodiment, said guiding device comprises a spindle nut, said spindle nut being journalled on said load-receiving device and surrounding said drive spindle, an additional guide rail being provided for guiding said spindle nut, said additional guiding rail extending alongside said flight of steps and being inclined relative to said support rails.

In such a lifting device, no chains or cables are required as bearing and traction means. No additional brake or safety device on the lifting device are necessary, since the drive by the driving spindle and the spindle nut is irreversible. The preferred arrangement of a second, unloaded spindle nut, in addition to the spindle nut transferring the movement, fulfils the requirement of the legally prescribed safety measures in a simple manner. The speed of the load-receiving device can be altered as desired by changing the angle of inclination of the guide rail, so that, for example in moving round a curve, it can be reduced in a spiral region of the steps with the result that any resulting centrifugal forces can be reduced. Such a reduction of the driving speed, produced by simple constructional measures, contributes to the safety of the user.

In a modified embodiment, said drive spindle is provided with a worm, the thread of said worm meshing with an associated worm wheel, the thread of which is developed and is provided on a plurality of identical segment plates fixedly arranged along the flight of steps and extending parallel thereto on said support rail, said plates having a partial thread as guiding device.

Such an embodiment is particularly suitable for use with long flights of steps, since any desired number of segment plates can be fixed at suitable spaced intervals along the sides of the steps. Continuous tubes or the like extending along the steps as separate guide means are unnecessary. The support rails may replace handrails in this case.

BRIEF DESCRIPTION OF THE DRAWINGS

The invention will be further described, by way of example, with reference to the accompanying drawings, in which:

FIG. 6 shows a schematic side view of a flight of steps with the lift device in operation;

FIG. 7 shows a partial vertical section from one side of the lift device fitted on a flight of steps;

FIG. 8 shows a partial vertical section taken from the front of a lift device fitted on a flight of steps; and FIG. 9 is a plan view of the worm seen in FIGS. 7 and 8 in engagement with the teeth of two adjacent segment plates also visible in FIGS. 7 and 8.

DESCRIPTION OF THE PREFERRED EMBODIMENTS

Figure 1:
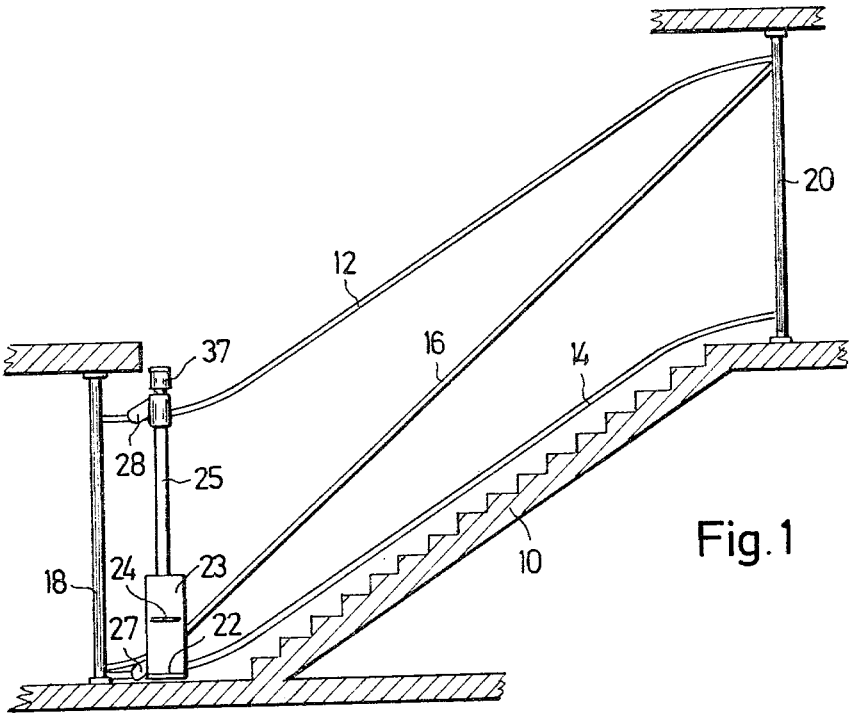
FIG. 1 shows a lift device fitted on a straight flight of steps.
Figure 2:
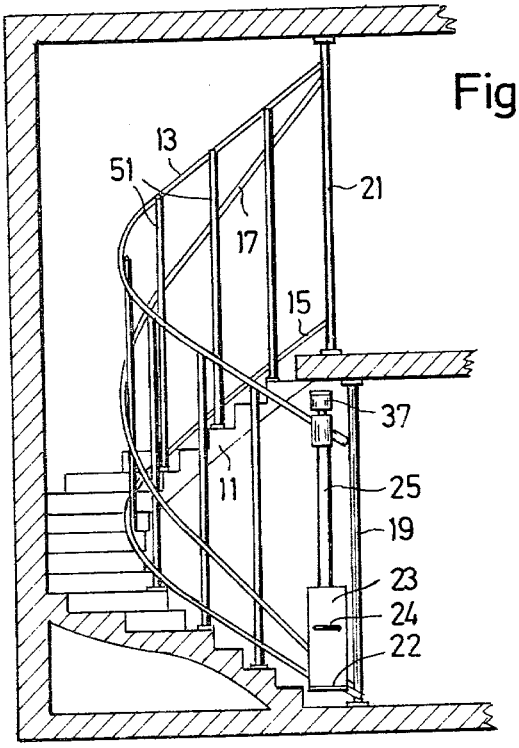
FIG. 2 shows a lift device fitted on a spiral flight of steps.
Figure 3:
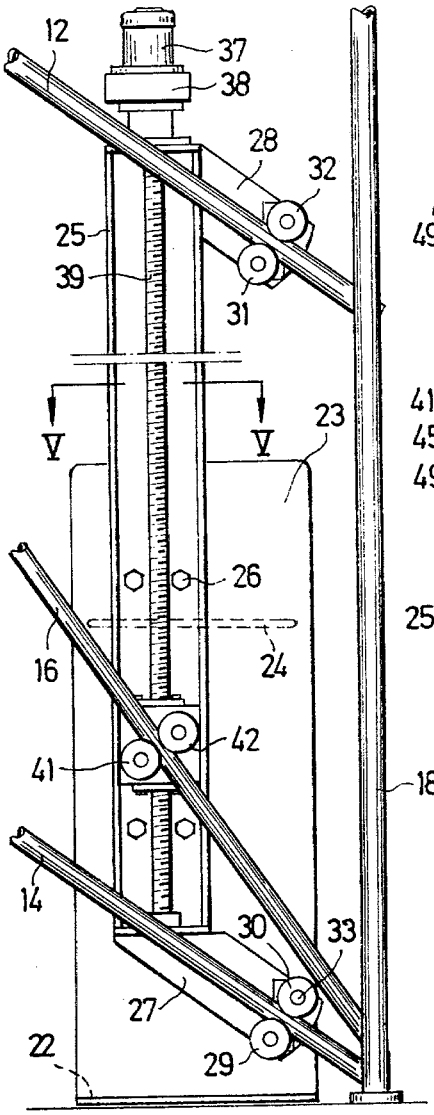
FIG. 3 shows a rear view on an enlarged scale, of the lift device shown in FIGS. 1 and 2.
Figure 4:
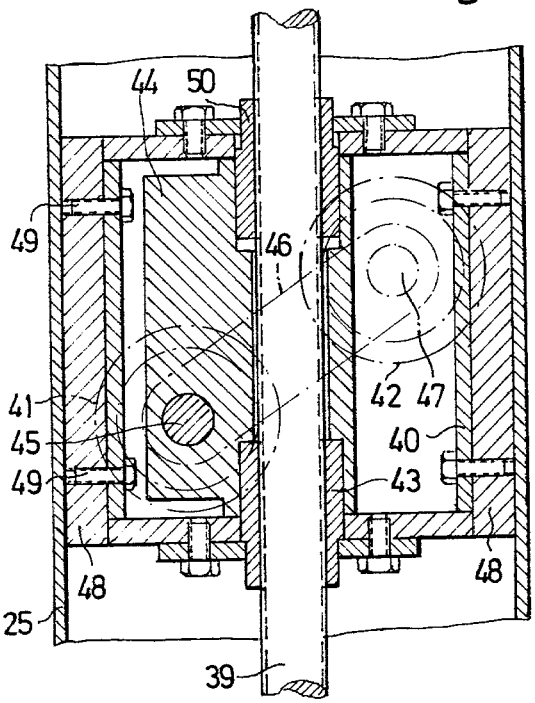
FIG. 4 shows a vertical section, on a further enlarged scale, through the connecting region of a lift unit and a guide rail therefor.

In FIGS. 1 and 2, there is shown a lift device fitted on a staircase which, in FIG. 1, comprises a straight flight of steps 10 and in FIG. 2 comprises a spiral flight of steps 11. The lift unit is supported on an upper support rail 12 (FIG. 1) or 13 (FIG. 2) and a lower support rail 14 (FIG. 1) or 15 (FIG. 2). Connecting the upper support rail 12 or 13 and the lower support rail 14 or 15, is a guide rail 16 or 17, the rail 16 or 17 connecting one end of the upper rail 12 or 13 to the opposed end of the lower rail 14 or 15. The rails 12, 14 and 16 or 13, 15 and 17 are located perpendicularly above one another and are each secured to a lower support member 18 (FIG. 1) or 19 (FIG. 2) at the lower end of the flight of steps and to an upper support 20 (FIG. 1) or 21 (FIG. 2) at the upper flight of steps. These supports extend vertically from the floor to the ceiling in a storey of a building.

The guide rail 16 or 17 determines the position of the lift unit along the steps. It extends from the lower end of the lower support rail 14 or 15 at the lower end of the flight of steps to the upper end of the upper support rail 12 or 13 at the upper end of the flight of steps. The support rails 12 to 15 and the guide rails 16 and 17 may be made from tubular material.

The lift unit comprises a horizontal platform 22 provided with a vertical wall 23 on which a shackle 24 is provided. Secured to the rear face of the wall 23 is a substantially C-shaped guide section 25, the securing being effected by means of bolts 26. The guide section 25 extends substantially vertically. On its lower end a lower gib 27 is secured and at its upper end, an upper gib 28 is secured. These gibs 27, 28 extend substantially parallel to the support rails 12 to 15 and are each provided, at their free end, with bearing rollers. The lift device is supported on the rails 12 and 14 or 13 and 15 by these bearing rollers. Thus, at the free end of the lower gib 27, a lower bearing roller 29 and an upper bearing roller 30 are provided, the rollers 29 and 30 being disposed on opposite sides of the lower support rail 14 or 15. In the same manner, the free end of the upper gib 28 is provided with a lower bearing roller 31 and an upper bearing roller 32 which are disposed on opposite sides of the upper support rail 12 or 13.

Figure 5:
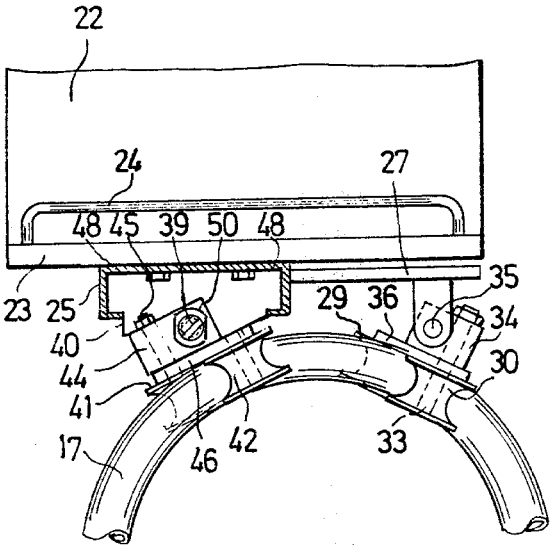
FIG. 5 shows a sectional view taken along the line V—V of FIG. 3 taken at a point at which the guide rail is passing through a curve.

The upper bearing roller 30 has a horizontal swivel axis which is journalled in a swivel bearing having a vertical axis, the swivel bearing being provided on the associated gib. The lower bearing roller 29 is journalled on a swivel lever rotatable about the swivel axis of the bearing roller. Thus, as shown in FIG. 5 of the drawings, the upper bearing roller 30 is linked by its swivel axle 33 to a bearing body 34 which latter is journalled by means of a swivel bearing 35 having a horizontal axis, to the gib 27. The swivel lever 36 is journalled on the bearing body 34 so as to rotate about the swivel axle 33; the lower bearing roller 29 being journalled to rotate at the free end of the lever 36. The lift unit is thus suspended from the support rails 12 and 14 or 13 and 15 by means of the bearing rollers 29 to 32 and can therefore travel on the support rails.

The drive unit of the lift device is located on the travelling lift unit and is in engagement with the guide rails 16 or 17. Such drive unit comprises a drive motor 37 provided on the upper end of the guide section 25, an associated gear system 38 and a vertical drive spindle 39 which is located within the guide section 25, the ends of the drive spindle being mounted on the guide section 25. The spindle 39 is joined to the guide rails 16 or 17 by means of a support frame 40, a lower bearing roller 41 and an upper bearing roller 42.

A spindle nut 43 is screwed onto the spindle 39 which acts as a guide device for the platform 22, which supports a bearing block bracket 44 enclosing the driving spindle 39. Inserted in a horizontal bore of this bearing block or bracket 44 is the axle 45 of a lower bearing roller 41 and of a swivel lever 46. On the free end of the axle 45 is mounted the upper bearing roller 42 having a horizontal axis 47. The lower bearing roller 41 and the upper bearing roller 42 are disposed on opposite sides of the guide rail 16 or 17 but externally of the guide section 25.

The bearing bracket or block 44 is disposed within the support frame 40 on which it is supported at its upper and its lower end, so that it must move therewith. The support frame 40 is displaceable in a vertical direction within the guide profile or bracket 25. For this purpose it is provided on two of its vertical outer faces with guide shoes 48. The shoes 48 are secured to the support frame 40 by means of bolts 49.

The bearing block or bracket 44 enclosing the drive spindle 39 is retained in a radial direction by the spindle nut 43 at its lower end and by a second spindle nut 50 at its upper end. It has vertical bores, the inner circular cylindrical upper surface of which are disposed against the outer surfaces of the spindle nuts 43 and 50. The bearing bracket or block 44 is vertically spaced with a small clearance, from the second spindle nut 50. This clearance is located at the lower end of the spindle nut 50. Moreover, the support frame 40 which, like the bearing block 44, is radially retained by the spindle nuts 43 and 50, is not in direct contact with the second spindle nut 50 in the axial direction of the drive, but maintains a small clearance therefrom. The support frame 40 and the bearing block or bracket 44 are thus retained against the drive spindle 39 only by means of the spindle nut 43. If, however, the nut 43 should become defective and fail, the retention is assumed by the second spindle nut 50. This provision of two spindle nuts 43 and 50 therefore provides a safety device so that the platform 22, which acts as a load receiving means is retained even if the main spindle nut 43 fails.

The operation of the lift device of the present invention will now be described.

Initially, the platform 22 is disposed at the lower end of a flight of steps. The drive motor 37 is switched on and by means of the gearing 38, causes the drive spindle 39 to rotate about its axis. The spindle nut 43 is secured to the support frame 40 in the radial direction and thus cannot rotate about its axis. When the drive spindle 39 rotates the spindle nut 43 must therefore move upwardly. At the same time, the bearing block 44 and the support frame 40 are caused to move therewith, the block and frame being displaced upwardly within the guide section 25. Since the bearing block or bracket 44 and the support frame 40, are also retained by the guide rail 16 or 17 by means of the bearing rollers 41 and 42, the rising movement within the guide section 25 can only take place when the guide rail 16 or 17 permits such movement. In other words, the movement can only occur when support rollers 41 and 42 can roll on the guide rails 16 or 17. Since the guide rails 16 or 17 are inclined, a vertical rising movement of the bearing block or bracket 44 necessarily involves movement of the guide profile 25 along the upper support rail 12 and the lower support rail 14 (or 13 and 15). The platform 22 therefore moves upwardly along the support rails alongside the steps 10 or 11. The downward movement thereof is effected by causing the drive spindle 39 to rotate in the opposite direction.

The main advantage of the present invention resides in that feature that a minimum number of rails need to be provided on the edge of the steps for the lift device. They may be provided on each side of the steps and together with additional limit rods 51, may serve as hand-rails. As shown in FIG. 1 of the drawings, the incline of the upper and lower support rails 12 and 14 in their end regions may be made variable. Thus, the rails may pass from a horizontal disposition into a constantly inclined disposition through a transition region at their lower ends. They then maintain this constant incline for the length of the steps and then pass through a second transition region from the inclined disposition into a horizontal disposition at their upper ends. Since the angle of incline of the guide rail 16 is substantially constant, the rails 12 and 14, which terminate at different angles of inclination, cause the speed of travel of the lift unit to be reduced in the end regions of these rails.

The use of the C-shaped guide profile or section affords further possibilities for the use of the lift. If, for example, the track defined by the support rails 12 and 14 and the guide rail 16 (FIG. 1) is rotated so that the rails 12 and 14 extend vertically, the lift can travel in a vertical direction. At the same time, the C-shaped guide section 25 and the driving spindle 39 retain their angular position relative to the support rails 12 and 14, whilst the platform 22 is so arranged relative to the guide section 25 that it remains horizontal. A horizontal direction of motion for the unit may be provided in a similar manner.

In the case of the embodiment shown in FIGS. 6 to 9, a lift device is suspended from a guide which can simultaneously serve as a banister. This guide comprises a lower guide or support rail 52 extending along the steps 10 and an upper guide or support rail 53 extending parallel thereto. These guide or support rails are retained by means of vertical supports 54 located above and on one side of the steps 10 and which are secured thereto. A plurality of cross bars 55 are secured to the guide rails 52 and 53 between two successive supports 54 at identically spaced intervals.

The load-receiving device of the lift, to which a side-seat 56 is secured near the steps 10, is suspended from the two guide rails 52 and 53 so as to be free to travel therealong. For this purpose, the guide rails 52 and 53 are made of tubular material of circular cross-section so that support rollers 65, can roll therealong. The load-receiving device is in the form of a frame having two vertical side struts 57, a lower cross strut 58, an upper cross strut 59, a lower connecting strut 60 and an upper connecting strut 61. The suspension of the frame on the guide rails 52 and 53 is effected by means of the connecting struts 60 and 61, each of which carries a plurality of support rollers capable of rolling along the guide rails.

A vertical roller support plate 63 is journalled to pivot on each connecting strut 60 and 61 in a bearing 62 secured thereto, the bearing having a horizontal axis. Fixed bearing pins 64 project horizontally from this roller bearing plate 63 and rotatably support two lower bearing rollers 65 and an upper bearing roller 66. The upper bearing roller 66 is supported against its associated guide rail 52 or 53 from above, the upper guide or support rail 53 extending parallel thereto.

The two lower support rollers 65 are supported one behind the other in the direction of travel of the lift device from below against the guide rail 52 or 53. The load-receiving device of the lift device may be adjusted relative to the guide rails 52 and 53 in this manner during its travel therealong to compensate for minor deviations in the parallelism of the rails. The support rollers 65 and 66 are each pivotally mounted on a pivotal roller support plate 63. For the drive of the lift device, a motor 68 located in a housing 67 and having a belt drive 69 is provided. The belt drive 69 drives a vertical driving spindle 70. The spindle 70 is rotatably mounted in a lower spindle bearing 71 secured to the lower cross strut 59 and in a spindle bearing 72 secured to the upper cross strut 59. To transmit the torque, the principle of a worm gear or the like is used. Accordingly, a worm or screw thread 73 is provided on the working spindle 70. Such thread does not, however, engage in a conventional worm gear. The threads in which it engages are distributed over a plurality of segment plates 74 acting as guide devices. A segment plate 74, secured by screws 75 is secured to each support 54 and to each rung 55 substantially centrally thereof between the two guide rails 52 and 53. In the inoperative position, the lift device is suspended on the guide rails 52 and 53. Since the thread of the worm 73 is in engagement at least with one segment plate 74 acting as a guide device, the load-receiving device is retained by means of the worm drive. Depending on the circumstances, the worm gear may be made self-locking. Thus, it is not possible for the weight of the load-receiving device to cause the worm 73 to start rotating of its own accord. However, as soon as the drive spindle 70 and, together therewith, the worm 73 are rotated, the worm engages with the thread of the segment plates 74 of the load receiving device and is compelled to move along the guide rails 52 and 53.

The manner of operation of the motor 68 can be controlled by the operator who is seated on the seat portion 56 utilising a control panel 77. The seat may be provided with a foot rest 76. The seat 56 can be easily dismantled and the foot rest 76 and control panel 77 can be easily raised if it is desired to utilise the full width of the flight of steps. This may be useful for transporting large items.

In the embodiment described, the drive spindle 70 and its associated worm 73 are arranged vertically. However, embodiments are also possible in which the drive spindle has a different orientation, such as inclined or horizontal. In such a case, the guide rails 52 and 53, acting as support rails, may be arranged in any desired direction.

The lift device of the present invention may also be in the form of a traction engine which pulls a plurality of load-receiving devices in series so that a plurality of persons and/or goods can be conveyed simultaneously.

I claim:

1. A lift device for moving a load receiving device such as a platform or a seat up or down a flight of stairs, said lift device comprising:

a vertical, threaded drive spindle rotatably secured to said load receiving device and movable therewith;

spaced support rails secured along the flight of stairs for supporting and guiding said spindle and said load receiving device;

guide means extending along the stairs intermediate said support rails;

drive means for rotating said drive spindle;

and means cooperating with said drive spindle and said guide means to cause said load receiving device to move up or down along the stairs as said drive spindle is rotated.

2. The lift device of claim 1 wherein said guide means is a guide rail extending along the stairs between said support rails and being inclined relative to said support rails.

3. The lift device of claim 2 wherein said means cooperating with said drive spindle and said guide rail is a spindle nut journaled on said load receiving device and engaging said drive spindle, said spindle nut being supported by upper and lower bearing rollers in contact with opposed faces of said guide rail, said drive means rotating said spindle so that said spindle nut is caused to raise or lower along said drive spindle to move said upper and lower bearing rollers along said inclined guide rail to move said load receiving device up or down the flight of stairs.

4. The lift device of claim 3 wherein said lower bearing roller is journaled in a bearing block slidably carried by said load receiving device, said lower bearing roller further including a swivel lever pivotably mounted about an axis of said lower bearing roller, said upper bearing roller also being journaled on said swivel lever.

5. The lift device of claim 4 wherein said bearing block encloses said drive spindle and supports a bearing frame, said bearing block carrying said spindle nut and further wherein a second spindle nut is carried by said bearing block and engages said drive spindle, said second spindle nut being spaced from said spindle nut and having a small clearance in an axial direction relative to said bearing block and said bearing frame.

6. The lift device of claim 1 wherein said threaded drive spindle is provided with a worm thread, said worm thread meshing with an associated worm wheel, the thread of said worm wheel being provided on a plurality of identical segment plates fixedly arranged along the flight of stairs and extending parallel to said support rails, said segment plates forming said guide means.

7. The lift device of claim 1 wherein said load receiving device is in the form of a frame having two vertical side struts, a lower horizontal cross strut, an upper horizontal cross strut and connecting struts arranged between said struts, said drive spindle being secured to said cross struts and said load receiving device being supported by support rollers which engage said support rails.

8. The lift device of claim 1 wherein each said support rail has at least an upper and a lower roller associated therewith, said upper and lower roller associated with each said support rail being journaled to rotate on a common roller bearing plate.

9. A lift device in accordance with claim 8 wherein each of said roller bearing plates is journaled to pivot about a horizontal axis in a bearing secured to said load receiving device.

* * * * *